US006123134A

United States Patent [19]

Thomas et al.

[11] Patent Number: 6,123,134

[45] Date of Patent: Sep. 26, 2000

[54] METHOD AND APPARATUS FOR REGULATING THE CLOSING SPEED OF A ROLLING FIRE DOOR

[75] Inventors: Gordon D. Thomas, Cincinnati; Michael L. Burns, Liberty Township, both of Ohio

[73] Assignee: Clopay Building Products Company, Inc., Cincinnati, Ohio

[21] Appl. No.: 09/287,458

[22] Filed: Apr. 7, 1999

[51] Int. Cl.[7] ..... E05F 15/20

[52] U.S. Cl. ..... 160/8; 160/296

[58] Field of Search ..... 160/8, 1, 7, 133, 160/9, 296, 405; 74/573 F; 188/290

[56] References Cited

U.S. PATENT DOCUMENTS

| | | | |
|---|---|---|---|
| 1,715,424 | 6/1929 | Ohno . | |
| 2,019,085 | 10/1935 | Miller . | |
| 2,946,377 | 7/1960 | Zoll et al. . | |
| 3,102,580 | 9/1963 | Greegor . | |
| 3,637,004 | 1/1972 | Wardlaw et al. . | |
| 4,012,968 | 3/1977 | Kelbel . | |
| 4,058,027 | 11/1977 | Webb . | |
| 4,147,197 | 4/1979 | Bailey et al. . | |
| 4,224,838 | 9/1980 | Roushdy et al. . | |
| 4,432,254 | 2/1984 | Schultz . | |
| 4,664,170 | 5/1987 | Labelle . | |
| 4,836,051 | 6/1989 | Guimbretie e . | |
| 4,905,808 | 3/1990 | Tomita et al. . | |
| 4,966,268 | 10/1990 | Asano et al. . | |
| 4,982,808 | 1/1991 | Taureg et al. . | |
| 5,007,515 | 4/1991 | Shimizu . | |
| 5,007,885 | 4/1991 | Yamamoto et al. . | |
| 5,012,908 | 5/1991 | Kobayashi et al. . | |
| 5,022,452 | 6/1991 | Burrell | 160/296 X |
| 5,031,743 | 7/1991 | Morishita et al. . | |
| 5,036,963 | 8/1991 | Murata . | |
| 5,056,640 | 10/1991 | Tamamoto . | |
| 5,063,738 | 11/1991 | Asano et al. . | |
| 5,070,975 | 12/1991 | Tanaka et al. . | |
| 5,080,187 | 1/1992 | Asano et al. . | |
| 5,127,503 | 7/1992 | Gratzer . | |
| 5,129,870 | 7/1992 | Pierce . | |
| 5,178,249 | 1/1993 | Haga et al. . | |
| 5,197,583 | 3/1993 | Sakai et al. . | |
| 5,203,392 | 4/1993 | Shea . | |
| 5,259,488 | 11/1993 | Oberdörster et al. . | |
| 5,261,862 | 11/1993 | Pierce . | |
| 5,267,916 | 12/1993 | Beim et al. . | |
| 5,355,927 | 10/1994 | McKeon | 160/8 X |
| 5,386,891 | 2/1995 | Shea | 160/7 X |
| 5,421,221 | 6/1995 | Warchocki | 74/573 F |
| 5,634,507 | 6/1997 | Kwoka | 160/296 X |

FOREIGN PATENT DOCUMENTS

| | | |
|---|---|---|
| 0 247 008 A1 | 11/1987 | European Pat. Off. . |
| 0 347 165 A2 | 12/1989 | European Pat. Off. . |
| 0 480 175 A1 | 4/1992 | European Pat. Off. . |
| 0 549 828 A1 | 7/1993 | European Pat. Off. . |
| 0 639 730 A2 | 2/1995 | European Pat. Off. . |
| 938813 | 2/1956 | Germany . |
| 41 03 054 A1 | 8/1991 | Germany . |
| 40 32 245 C1 | 3/1992 | Germany . |
| 64-87928 | 4/1989 | Japan . |
| 1-126440 | 5/1989 | Japan . |
| 1-220728 | 9/1989 | Japan . |
| 2-51626 | 2/1990 | Japan . |

(List continued on next page.)

OTHER PUBLICATIONS

Amy Schmitt, *SPEED Governors*, The Construction Specified, Aug. 1995 (pp. 87 & 89).

Vibratech, Inc., *VIBRATECH® VSG™*, Vibratech, Inc. sales brochure (no date).

*Primary Examiner*—David M. Purol

*Attorney, Agent, or Firm*—Wood, Herron & Evans, L.L.P.

[57] ABSTRACT

A mechanism for regulating the closing speed of a rolling fire door during an emergency condition. The speed regulating mechanism includes a viscous speed governor which is operatively connected to the support shaft of the fire door for providing a speed regulating damping torque as the door moves to a closed position. Methods for regulating the closing speed of a fire door during an emergency condition are also disclosed.

48 Claims, 3 Drawing Sheets

FOREIGN PATENT DOCUMENTS

| | | |
|---|---|---|
| 2-120529 | 5/1990 | Japan . |
| 2-120530 | 5/1990 | Japan . |
| 3-37455 | 2/1991 | Japan . |
| 3-69829 | 3/1991 | Japan . |
| 2 202 602 | 9/1988 | United Kingdom . |
| 2 222 232 | 2/1990 | United Kingdom . |

METHOD AND APPARATUS FOR REGULATING THE CLOSING SPEED OF A ROLLING FIRE DOOR

FIELD OF THE INVENTION

The present invention relates generally to rolling doors and more particularly, to a door operator for controlling the rate of descent of a rolling fire door.

BACKGROUND OF THE INVENTION

Mechanisms to control the lowering and closing speed of rolling doors or shutters have been in use for several years. Among the doors controlled by these regulating mechanisms are rolling fire doors, which generally include a curtain of horizontally interconnected slats connected at one end to a rotatable support shaft. Upon winding of the support shaft, the door is raised to its open position. The door is operable to unwind or unroll by the urging of gravity or under motor control to its lowered or closed position.

In operation, rolling fire doors release from their open position during an emergency and close by gravity or in some designs, by motor operation. In the absence of a speed regulating mechanism to control the rotational speed of the support shaft, the speed at which the door descends increases as the door drops, and the door could be damaged upon impacting the floor, thus failing to seal off the door opening. Additionally, a free-falling door could cause serious injury to persons.

Numerous mechanisms are known and have been used for controlling the speed of descent of such doors in a fire or other emergency situation, such as centrifugal brakes, oscillating governors or viscous speed governors attached to the support shaft of the rolling door. These regulating mechanisms differ significantly in their respective application of braking force to the support shaft of the rolling fire doors.

Centrifugal brakes generally consist of a brake drum and a brake shoe. Two tension springs hold the brake shoes in a closed position until the support shaft attached to the centrifugal brake is rotated at or above a preset speed at which point the brake shoes begin to separate due to centrifugal force and thus apply a braking force against the inside of the brake drum to slow the speed of the rotating support shaft.

Oscillating governors generally comprise a gear mechanism coupled to the support shaft and an oscillating ring associated with the door operator. During closing movement of the fire door, the ring is adapted to swing in a back-and-forth motion as it engages teeth of the gear mechanism. The teeth disposed on the ring component intermittently abut the outer surface of the gear, thereby regulating the rate of descent of the rolling door.

Viscous speed governors generally use the shear force of a viscous fluid to retard the rate of descent of rolling fire doors. Typically, a support shaft of the rolling door includes one or more disc-shaped members that are keyed to and rotate with the support shaft. The disc-shaped members rotate within a housing of the viscous speed governor. As the disc-shaped members rotate within the housing, a shear film of a viscous fluid damping medium resists movement of the disc-shaped members relative to the housing. In rolling fire door environments, as the rotational speed of the rotating disc-shaped member within the viscous governor increases, the viscous governor provides a higher damping torque to the support shaft to thereby reduce the rate of descent of the door. The descent rate may be further manipulated by increasing or decreasing the viscosity of the fluid within the governor. The primary operational difference between a viscous speed governor and a centrifugal brake shoe is that the latter provides a somewhat constant braking force once it is actuated, whereas in the former, the damping torque applied increases with an increasing RPM of the support shaft and its associated disc-shaped member of the viscous speed governor.

In rolling fire door environments, several problems are typically associated with the use of centrifugal brakes. For example, the centrifugal brake creates a significant amount of unwanted noise during its operation as a result of the contact between the brake shoe and the brake drum. Additionally, centrifugal brakes provide a generally constant braking force once a certain RPM of the support shaft has been achieved, and the braking does not increase with an increased rotational speed of the support shaft.

Problems are also associated with the use of the oscillating governors in rolling fire door environments, including unwanted noise and the inability to accurately regulate the rate of descent of the door.

In the past, mechanisms to control the rate of descent of rolling fire doors have been connected directly to the support shaft of the door. To control the rate of descent of larger fire doors, multiple speed regulating mechanisms have been attached to the support shaft of the door in a stacked arrangement. In "stacking", multiple braking mechanisms are mounted or associated with the support shaft of the rolling door curtain. "Stacking" results in several known problems, including additional space requirements, additional cost and door size limitations. Often, the fire door is covered by a hood which envelopes the curtain of the door in its raised position and extends along the lintel at the top of the door opening. Generally, this allows very little space in which to place a speed regulation mechanism. As more speed regulating mechanisms are "stacked", the problem of limited space is exacerbated. "Stacking" is also a costly solution as each additional braking unit adds to the cost of the rolling fire door system. Moreover, with "stacking", the maximum door size is limited since the resulting damping torque from the "stacked arrangement" only increases fractionally with each added speed regulating mechanism which limits the use of this approach.

Accordingly, it is desirable to operatively connect a speed regulating mechanism to a rolling fire door in a manner that eliminates the problems of space, door size limitations, and cost associated with stacking of speed regulating mechanisms. It is also desirable to have a speed regulating mechanism which can operate with minimal noise. Likewise, it is desirable to have a speed regulating mechanism which has a reduced potential of seizing or jamming during its use. Finally, it is desirable to have a speed regulating mechanism which is capable of consistently, accurately, and safely regulating the closing speed of rolling fire doors of various sizes.

SUMMARY OF THE INVENTION

The present invention solves the problems associated with speed regulating mechanisms and methods heretofore known for controlling the speed of descent of rolling fire doors.

The speed regulating mechanism of the present invention includes a first shaft for supporting and winding a rolling fire door. A curtain of a rolling fire door is attached to this first shaft at one end. Thus, the curtain may be wound or unwound around this first shaft to open and close the rolling fire door over a wall opening. The speed regulating mechanism also includes a second shaft operatively connected to the first shaft, and a viscous speed governor operatively connected to the second shaft. The first shaft operates to rotate at a first rotational speed upon closing of the fire door. The second shaft is operatively connected to this first shaft through a gear system, chain, belt, or any other appropriate mechanism which may be apparent to those skilled in the art. The second shaft is adapted to rotate at a second rotational speed upon closing of the fire door which is greater than the first rotational speed of the first shaft.

In accordance with the principles of the present invention, the viscous speed governor operatively connected to the second shaft is adapted to apply a damping torque to the second shaft upon closing of the fire door to thereby regulate the rotational speed of the first shaft and the descent rate of the fire door. The damping torque applied to the second shaft is substantially determined by the faster rotational speed of the second shaft. As the second rotational speed is greater than the first rotational speed of the first shaft, the viscous speed governor provides a greater damping torque to regulate the closing speed of the fire door than would be provided if the viscous speed governor were mounted on the first shaft supporting the fire door.

For example, if the gear ratio of the second shaft to the first shaft is 5:1, then the rotational speed of the second shaft will be five times greater than that of the first shaft. Assuming that the first shaft is rotating at 25 RPM, a viscous speed governor attached to the first shaft will apply a damping torque consistent with a shaft rotational speed of 25 RPM. However, a viscous speed governor located on the second shaft will apply a damping torque consistent with a shaft rotational speed of 125 RPM to regulate the rate of closing of the rolling fire door. Thus, the viscous speed governor attached to the second shaft provides a higher damping torque determined by the higher rotational speed of the second shaft to regulate the speed of descent of the rolling fire door.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
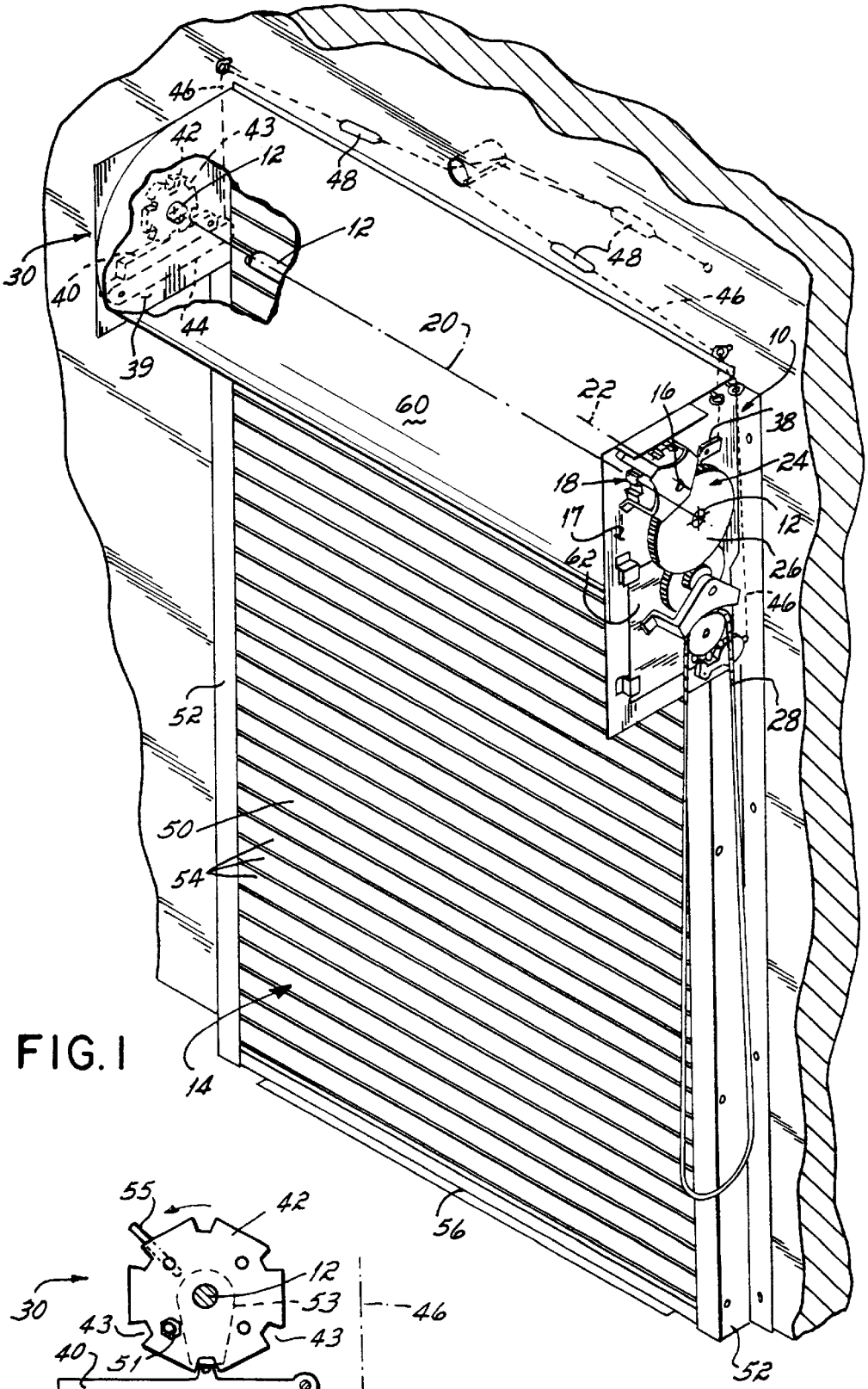
FIG. 1 is a perspective view of a rolling fire door and a regulating mechanism in accordance with the principles of the present invention.

With reference to the figures, a speed regulating mechanism 10 in accordance with the principles of the present invention is shown in combination with a rolling fire door 12 to control the speed of descent of the door 12 during an emergency drop. The mechanism 10 includes a first shaft 14 adapted to support the rolling door 12 in a known manner, and is operable to rotate at a first rotational speed during closing movement of the door 12. A second shaft 16 is operatively connected to the first shaft 14 and is operable to rotate at a second rotational speed upon closing movement of the fire door 12. As will be described in detail below, the second rotational speed of second shaft 14 is greater than the first rotational speed of first shaft 14. A viscous speed governor 18 is operatively connected to the second shaft 16. In accordance with the principles of the present invention, viscous speed governor 18 applies a damping torque to the second shaft 16 that is substantially determined by the faster rotational speed of the second shaft 16 to thereby regulate the first rotational speed of the first shaft 14 during closing movement of the rolling fire door 12.

Figure 2:
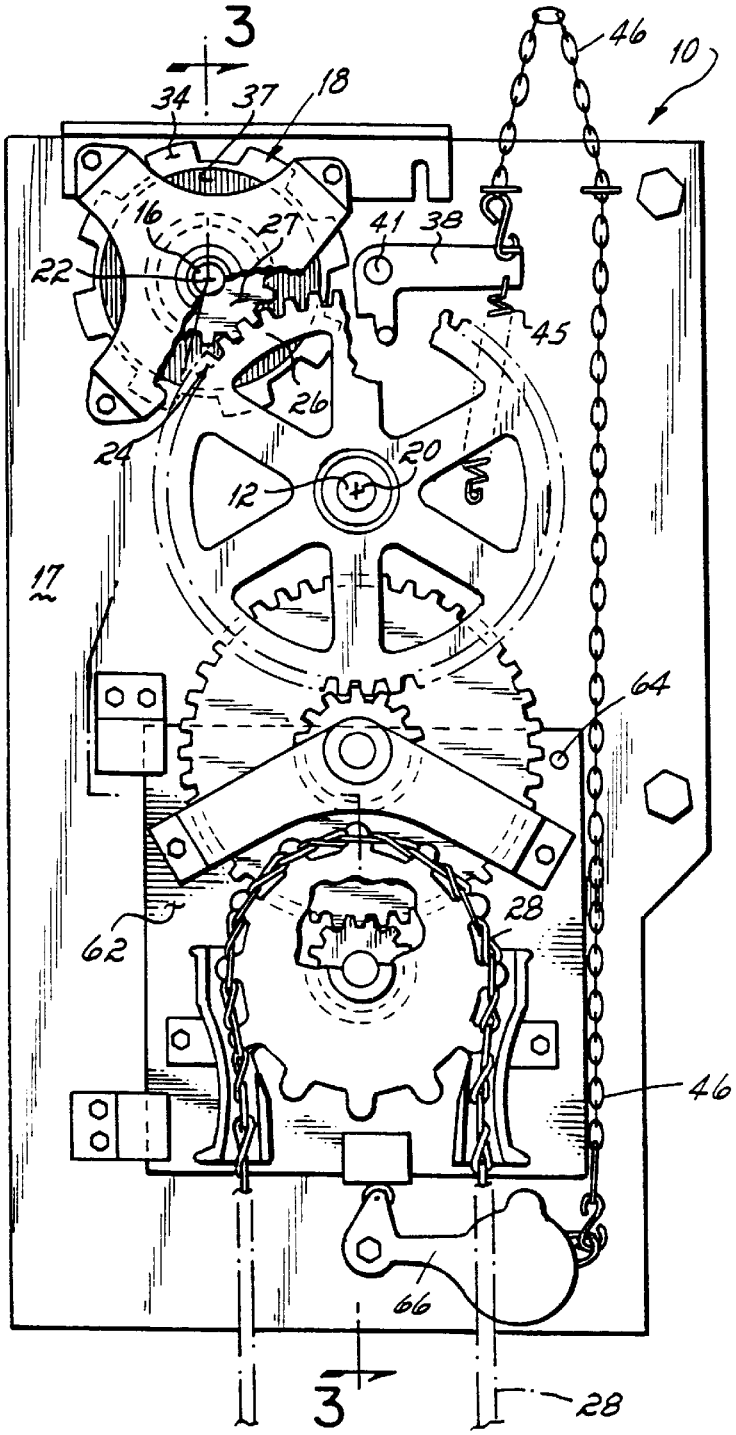
FIG. 2 is an enlarged plan view partially broken away, of the speed regulating mechanism.
Figure 3:
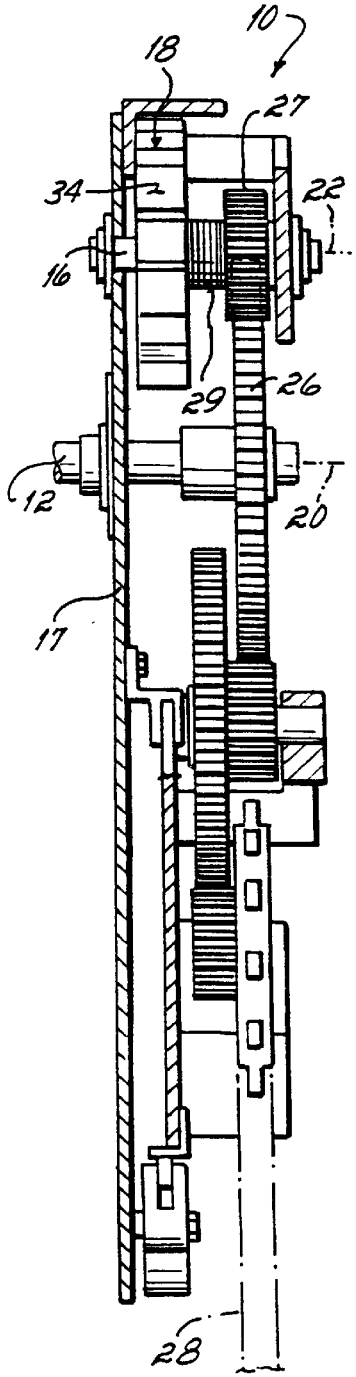
FIG. 3 is a cross section of the speed regulating mechanism of the present invention taken along lines 3—3 of FIG. 2.

An adjusting side bracket plate 20 is attached to one end of the first shaft 14. A drive side bracket plate 22 is attached to the end of the first shaft 14 opposite the adjusting side bracket plate 20. Referring to FIGS. 2 and 3, the speed regulating mechanism 10 of the present invention is attached to the drive side bracket plate 22. The first shaft 14 of the mechanism 10 extends through an aperture in the drive side bracket plate 22. A spur gear 24, which rotates cooperatively with the first shaft 14 is operably connected to the first shaft 14 proximate to its terminus. The teeth of the spur gear 24 intermesh with teeth of a gear 28 that is operatively connected to the terminus of the second shaft 16 which extends through an aperture in the drive side bracket plate 22. The gear 26 rotates cooperatively with the second shaft 16.

In one embodiment of the present invention, the gear 28 of the second shaft 16 has a 3 inch radius and is driven by the larger spur gear 24 of the first shaft 14, while the spur gear 24 has a radius which varies dependant on the size of the door 12 to be regulated. The combination and interplay of the spur gear 24 and gear 28 form a gear assembly 28 mounted to the first shaft 14 and second shaft 16 which are located at an upper corner of the drive side bracket plate 22. The gear 28 operatively connected to the second shaft 16 can be laterally adjusted to mate with the spur gear 24 by placing spacer washers 30 around the second shaft 16 proximate to the gear 26. In one embodiment of the present invention, the spur gear 24 of the gearing assembly 26 for operatively connecting the first shaft 14 to the second shaft 16 is of a larger diameter than that of gear 26. The relative sizes of spur gear 24 and gear 26 of the gearing assembly 26 create a gear ratio resulting in the second shaft 16 rotating at a greater rotational speed than the first shaft 14. Alternative embodiments of the present invention may use a belt or chain (not shown) to operatively connect the first shaft 14 to the second shaft 16 will be appreciated by those skilled in the art.

In one embodiment of the present invention, the axis of the second shaft 16 is not coaxial with the axis of the first shaft 14. However, the axes of the first shaft 14 and second shaft 16 are parallel to each other. The viscous speed governor 18 is operatively connected to the second shaft 16 in order to thereby regulate the rotational speed of the second shaft 16, ultimately regulating the closing speed of the rolling door 12. The configuration of the speed regulating mechanism 10 including the viscous speed governor 18 mounted on the second shaft 16 apart from the first shaft 14 upon which the door 12 is wound, is referred to as a "compound type drive." This compound type drive is well suited for use in larger fire doors (those with a size greater than 180 sq. ft.).

The viscous speed governor 18 of the speed regulating mechanism 10 comprises a housing 32, a rotatable member 34 located within the housing 32 and a viscous fluid filling the chamber within the housing 32. The housing 32 of the viscous speed governor 18 is adapted to rotate independently of the inner rotatable member 34 which is keyed to the second shaft 16. As the second shaft 16 rotates, the rotatable member 34 rotates with the shaft 16. In turn, the housing 32 indirectly rotates with the second shaft 16. However, upon the introduction of an impediment to the rotation of the housing 32, the housing 32 will remain stationary while the inner rotatable member 34 rotates with the second shaft 16. In one embodiment of the present invention, the rotatable member 34 is an annular disc. In alternative embodiments, this rotatable member 34 may comprise a plurality of vanes. Suitable viscous speed governors for use in the present invention are commercially available from Vibratech, Inc. of Buffalo, N.Y.

A stop arm 36 is attached to the drive side bracket plate 22 in close proximity to the viscous speed governor 18. This stop arm 36 is "L" shaped and pivots about a pivot pin 38. As the stop arm 36 pivots it engages the housing 32 of the viscous speed governor 18. During normal operation, the stop arm 36 is held out of engagement with the viscous speed governor housing 32 by a sash chain 40. During an emergency drop the stop arm 36 is released and pivots to engage the housing 32 of the viscous speed governor 18.

The stop arm 36 is held at one end by a stop arm spring 42. The opposite end of the stop arm spring 42 is attached to the drive side bracket plate 22. This spring 42 provides the force to rotate the stop arm 36 about its pivot pin 38 to engage housing 32 of the viscous speed governor housing 18. When the stop arm 36 engages the housing 32, it prevents the housing 32 from rotating. However, as nothing impedes the movement of the inner rotatable member 34, it continues to rotate cooperatively with the second shaft 16 inside the chamber of the housing 32, which is now fixed in space. With the position of the housing 32 fixed, the rotatable member 34 must move relatively against and through the viscous fluid contained within the housing 32. In turn, the shear film of the viscous damping medium will dampen the movement of the rotatable member 34 and thereby the relative rotational speed of the second shaft 16 of the mechanism 10. Through the gear ratio of the gear assembly 24, the damping torque substantially determined by the rotational speed of the second shaft 16 will ultimately regulate the rotational speed of the first shaft 14 and thus regulate the rate of descent of the rolling fire door 12. For example, if the gear ratio of the spur gear 24 to the gear 26 is 5:1, then the rotational speed of the second shaft 16 will be five times greater than that of the first shaft 14. Assuming that the first shaft 14 is rotating at 25 RPM, the viscous speed governor 18 operatively connected to the second shaft 16 will apply a damping torque consistent with a shaft rotational speed of 125 RPM to regulate the rate of closing of the rolling fire door 12. Thus, the viscous speed governor 18 attached to this second shaft 16 takes advantage of the higher damping torques available at higher shaft rotational speeds to effect a regulation of the speed of descent of the rolling fire door 12.

Figure 4:
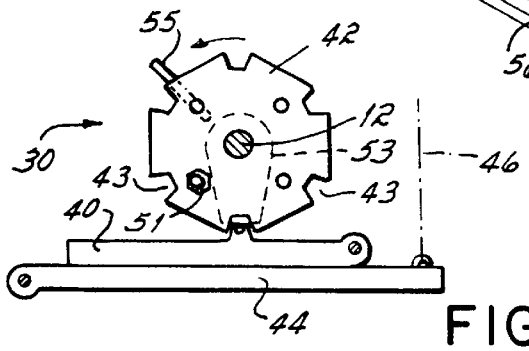
FIG. 4 is an enlarged view of the charge wheel release mechanism of the present invention.

A charge wheel release mechanism 44 is attached to the adjusting side bracket plate 20 at an end of the first shaft 14 opposite that of the drive side bracket plate 22. The charge wheel release mechanism 44 assists the closing of the door 12 under gravitational pull. Referring to FIG. 4, the charge wheel release mechanism 44 includes a spring tension charge wheel 46, a tension lock bar 48 and a drop out bar 50. The spring tension is adjusted by rotating the charge wheel 46 operatively connected to the first shaft 14. This results in the torsion spring (not shown) exerting a large force on the charge wheel 46. The structure of the charge wheel 46 and the tension lock bar 48 prevent the free rotation of the charge wheel 46 under the force of the torsion springs (not shown). The periphery of the charge wheel 46 comprises several recess notches 52. The tension lock bar 48 includes a raised portion of its surface which is compatible with a recess notch 52. After the raised portion of the tension lock bar 48 engages a recess notch 52, thereby preventing rotation of the charge wheel 46, the drop out bar 50 is raised against the tension lock bar 48 to hold the tension lock bar 48 and charge wheel 46 in engagement. The drop out bar 50 is held in its raised position by the sash chain 40. The torsion spring (not shown) may be incorporated within the barrel of the first shaft 14 and provides the force for the initial rotation of the first shaft 14 to facilitate closing movement of the rolling door 12 once the charge wheel 46 is released.

Referring now to FIG. 1 the rolling fire door 12 includes a curtain 54 comprising a plurality of interconnected horizontal slats 56 kept in alignment by endlocks (not shown). The top of the curtain 54 of the rolling door 12 is fixed to the rotatable first shaft 14 upon which the curtain 54 can wind to a raised or open position and unwind to a lowered or closed position. A large portion of the first shaft 14 may be covered by a hood 58. The curtain 54 of the rolling fire door 12 is sized to fit a door opening in a wall. The door 12 also includes a pair of vertical guides 60 which aid the movement of the curtain 54 from an open to a closed position. The vertical guides 60 are positioned on either side of the curtain 54 and are secured to a wall or door frame or other structure. The type of door jamb to which the vertical guides 60 are mounted may be steel, masonry, or non-masonry. An exact distance between the guides 60 needs to be maintained from top to bottom of the opening to be covered by the curtain 54. The bottom of the curtain 54 may include a bottom slat which forms a bottom bar 62 on the door 12. The door 12 further includes a hand chain assembly 64 operatively connected to the first shaft 14 for raising the door 12 to its open position.

Referring to FIGS. 1–4, the mechanism by which the door 12 is released to close under gravity comprises a fusible link 66 and sash chain 40. The sash chain 40 is connected to the fusible link 66 which is temperature sensitive. The fusible link 66 comprises two pieces of metal held together by a low melting point solder. The fusible links 66 are placed where they are most exposed to possible fire. The sash chain 40 connects the fusible links 66 to all release mechanisms and is free to move smoothly. The fusible links 66 and sash chain 40 are installed and routed so that the failure (or melting) of any single fusible link permits the door 12 to drop. In one embodiment of the present invention, one fusible link 66 is located within 12 inches of a ceiling. While the fusible link 66 is intact, the sash chain 40 holds the drop out arm 50 against the tension lock bar 48, which in turn engages a recess notch 52 to prevent the spring tension charge wheel 46 from rotating to close the door 12. This sash chain 40 also holds the stop arm 36 out of engagement with the rotatable housing 32 of the viscous speed governor 18. When the ambient temperature surrounding the door 12 reaches a predetermined level, the low melting point solder melts and the fusible link 66 separates, releasing the tension on the sash chain 40. With this tension removed, the sash chain 40 releases the drop out arm 50 which swings away from the tension lock bar 48. As a result the tension lock bar 48 becomes disengaged from the spring tension charge wheel 46. With no means to hold the spring force, the first shaft 14 (to which the charge wheel 46 is operatively connected)

begins to rotate, releasing spring tension. In order to allow only a portion of the spring force to be used to automatically close the door 12, a starter bolt 68 is located in one of four positions on the face of the charge wheel 46. As the charge wheel 46 rotates, the end of the starter bolt 68 strikes a swing stop 70 behind the charge wheel 46. Both components rotate together until they are restricted by a stop bar 72 welded to the adjusting side bracket plate 20.

The separation of the fusible link 66 allows the first shaft 14 to begin to rotate as described above, which through the gear ratio of the gearing assembly 26, results in the rotation of the second shaft 16 at a greater rotational speed than the first shaft 14. As the fusible link 66 breaks, and as the rotation of the charge wheel 46, first shaft 14 and second shaft 16 is effected, the stop arm 36 which is also connected to the sash chain 40 releases and pivots about pivot pin 38 by the force of the stop arm spring 42 to engage and hold the housing 32 of the viscous speed governor 18 stationary. As the first shaft 14 and the second shaft 16 rotate, the rotatable member 34 of the viscous speed governor 18 moves against and through the viscous fluid within the housing 32 of the viscous speed governor. This dampens the movement of the rotatable member 34 within the housing 32 of the viscous speed governor 18 to thereby reduce the relative rotational speed of the second shaft 16 of the mechanism 10. By using the gear ratio of the gearing assembly 26, the damping torque substantially determined by the rotational speed of the second shaft 16 regulates the rotational speed for the first shaft 14 and thus the speed of descent of the rolling fire door 12.

Figure 2A:
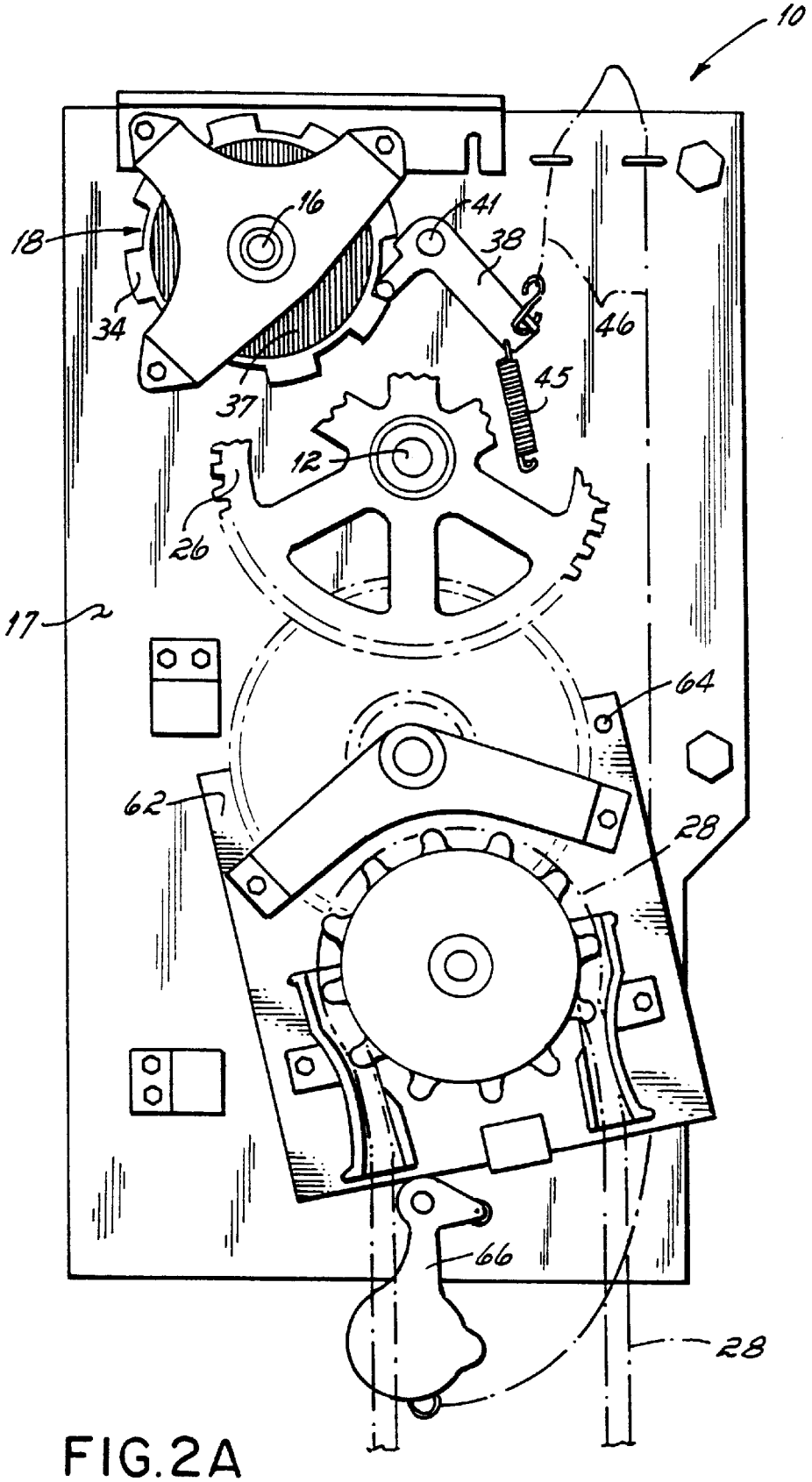
FIG. 2A is a view similar to FIG. 2 illustrating the drop out plate of the regulating mechanism.

The failure of the fusible link 66 has another effect coinciding with the release of the charge wheel release mechanism 44 and release of the stop arm 36 to engage the viscous speed governor housing 32. As can be seen in FIG. 2A, a drop out plate 74 is used to prevent the hand chain assembly 64 from becoming caught in the gear assembly 28 and jamming the mechanism 10, thereby preventing the closing of the fire door 12 during an emergency. As the fusible link 66 melts and sash chain 40 drops, a roll away arm 76, held against the dropout plate 74, pivots about a pin 78, and allows the drop out plate 74 to rotate about pivot pin 80. This pivoting motion results in the drop out plate 74 moving laterally, thereby disengaging the hand chain assembly 64 from the first shaft 14.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative mechanism and method, and illustrative example shown and described. Accordingly, departures may be made from such details without departing from the spirit or scope of applicants' general inventive concept.

What is claimed is:

1. An apparatus for controlling closing movement of a rolling door during an emergency condition comprising:

a first shaft adapted to support the rolling door, the first shaft operable to rotate at a first rotational speed during closing movement of the rolling door;

a second shaft operatively connected to said first shaft and operable to rotate at a second rotational speed which is greater than the first rotational speed of said first shaft during closing movement of the door; and a viscous speed governor operatively connected to said second shaft for applying a damping torque to said second shaft to thereby regulate the first rotational speed of said first shaft during closing movement of the rolling door during the emergency condition.

2. The apparatus of claim 1 wherein said viscous speed governor is operable to apply a damping torque to said second shaft that is substantially determined by the second rotational speed of said second shaft during closing movement of the rolling door.

3. The apparatus of claim 2 wherein said viscous speed governor further comprises a housing independently rotatable about said second shaft, and an annular disc within said housing operatively connected to said second shaft and rotatable with said second shaft.

4. The apparatus of claim 1 wherein said first shaft and said second shaft have parallel axes.

5. The apparatus of claim 1 further comprising a gearing assembly operatively connecting said first shaft to said second shaft.

6. The apparatus of claim 5 wherein said gearing assembly includes a spur gear mounted on said first shaft.

7. The apparatus of claim 5 wherein said gearing assembly includes a first gear operatively connected to said first shaft and a second gear operatively connected to said second shaft.

8. The apparatus of claim 7 wherein teeth of said first gear intermesh with teeth of said second gear.

9. The apparatus of claim 7 wherein said second gear is of smaller diameter than said first gear, whereby said second rotational speed is greater than said first rotational speed.

10. The apparatus of claim 1 wherein said first shaft is operatively connected to a mechanism for rotating said first shaft.

11. The apparatus of claim 10 wherein said mechanism for rotating said first shaft comprises a hand chain assembly.

12. The apparatus of claim 1 further comprising a charge wheel operatively connected to said first shaft and a tension lock bar engageable with said charge wheel for preventing rotation of said first shaft when said door is in an open position.

13. The apparatus of claim 12 further comprising a charge wheel release operatively connected to said tension lock bar for disengaging said tension lock bar from said charge wheel, thereby permitting rotation of said first shaft.

14. The apparatus of claim 13 wherein said viscous speed governor further comprises a housing independently rotatable about said second shaft, and an annular disc within said housing operatively connected to said second shaft and rotatable with said second shaft.

15. The apparatus of claim 14 further comprising a stop arm adapted to engage said housing of said viscous speed governor, thereby preventing rotation of said housing and thereby limiting rotational speed of said second shaft.

16. The apparatus of claim 15 wherein said annular disc within said housing is rotatable with said second shaft as said housing is prevented from rotating independently about said second shaft.

17. A rolling door comprising:

a curtain having a plurality of interlocking horizontal slats;

two guide assemblies, one positioned on each side of said curtain for guiding said curtain during vertical movement between an open position and a closed position;

a horizontal first shaft operable to rotate at a first rotational speed and operatively connected to the top of said curtain for winding said curtain thereabout for raising said curtain to said open position and for unwinding said curtain to said closed position; and an apparatus for controlling closing movement of said door during an emergency condition comprising a second shaft operatively connected to said first shaft and operable to rotate at a second rotational speed which is greater than said first rotational speed upon closing movement of said door, and a viscous speed governor operatively connected to said second shaft for applying a damping torque to said second shaft to thereby regulate the first rotational speed of said first shaft during closing movement of the door during the emergency condition.

18. The door of claim 17 wherein said viscous speed governor is operable to apply a damping torque to said second shaft that is substantially determined by said second rotational speed of said second shaft during closing movement of the door.

19. The door of claim 18 wherein said viscous speed governor further comprises a housing independently rotatable about said second shaft, and an annular disc within said housing operatively connected to said second shaft and rotatable with said second shaft.

20. The door of claim 17 wherein said first shaft and said second shaft have parallel axes.

21. The door of claim 17 further comprising a gearing assembly operatively connecting said first shaft to said second shaft.

22. The door of claim 21 wherein said gearing assembly includes a spur gear mounted on said first shaft.

23. The door of claim 21 wherein said gearing assembly includes a first gear operatively connected to said first shaft and a second gear operatively connected to said second shaft.

24. The door of claim 23 wherein teeth of said first gear intermesh with teeth of said second gear.

25. The door of claim 23 wherein said second gear is of smaller diameter than said first gear, whereby said second rotational speed is greater than said first rotational speed.

26. The door of claim 17 wherein said first shaft is operatively connected to a mechanism for rotating said first shaft.

27. The door of claim 26 wherein said mechanism for rotating said first shaft comprises a hand chain assembly.

28. The door of claim 17 further comprising a charge wheel operatively connected to said first shaft and a tension lock bar engageable with said charge wheel for preventing rotation of said first shaft when said door is in said open position.

29. The door of claim 28 further comprising a charge wheel release operatively connected to said tension lock bar for disengaging said tension lock bar from said charge wheel, thereby permitting rotation of said first shaft.

30. The door of claim 29 wherein said viscous speed governor further comprises a housing independently rotatable about said second shaft, and an annular disc within said housing operatively connected to said second shaft and rotatable with said second shaft.

31. The door of claim 30 further comprising a stop arm adapted to engage said housing of said viscous speed governor, thereby preventing rotation of said housing and thereby limiting rotational speed of said second shaft.

32. The door of claim 31 wherein said annular disc within said housing is rotatable with said second shaft as said housing is prevented from rotating independently about said second shaft.

33. A method for regulating the closing speed of a rolling door during an emergency condition, comprising the steps of:

providing a first shaft adapted to support the rolling door, said first shaft operable to rotate at a first rotational speed during closing movement of the rolling door;

providing a second shaft operatively connected to said first shaft and operable to rotate at a second rotational speed which is greater than said first rotational speed upon closing movement of said door; and providing a viscous speed governor operatively connected to said second shaft for applying a damping torque to said second shaft to thereby regulate said first rotational speed of said first shaft during closing movement of the rolling door during the emergency condition.

34. The method of claim 33 wherein said viscous speed governor is operable to apply a damping torque to said second shaft that is substantially determined by said second rotational speed of said second shaft during closing movement of the rolling door.

35. The method of claim 34 wherein said viscous speed governor further comprises a housing independently rotatable about said second shaft, and an annular disc within said housing operatively connected to said second shaft and rotatable with said second shaft.

36. The method of claim 33 wherein said first shaft and said second shaft have parallel axes.

37. The method of claim 33 further comprising a gearing assembly operatively connecting said first shaft to said second shaft.

38. The method of claim 37 wherein said gearing assembly includes a spur gear mounted on said first shaft.

39. The method of claim 37 wherein said gearing assembly includes a first gear operatively connected to said first shaft and a second gear operatively connected to said second shaft.

40. The method of claim 39 wherein teeth of said first gear shaft intermesh with teeth of said second gear.

41. The method of claim 39 wherein said second gear is of smaller diameter than said first gear, whereby said second rotational speed is greater than said first rotational speed.

42. The method of claim 33 wherein said first shaft is operatively connected to a mechanism for rotating said first shaft.

43. The method of claim 42 wherein said mechanism for rotating said first shaft comprises a hand chain assembly.

44. The method of claim 33 further comprising a charge wheel operatively connected to said first shaft and a tension lock bar engageable with said charge wheel for preventing rotation of said first shaft when said door is in an open position.

45. The method of claim 44 further comprising a charge wheel release operatively connected to said tension lock bar for disengaging said tension lock bar from said charge wheel, thereby permitting rotation of said first shaft.

46. The method of claim 45 wherein said viscous speed governor further comprises a housing independently rotatable about said second shaft, and an annular disc within said housing operatively connected to said second shaft and rotatable with said second shaft.

47. The method of claim 46 further comprising a stop arm adapted to engage said housing of said viscous speed governor, thereby preventing rotation of said housing and thereby limiting rotational speed of said second shaft.

48. The method of claim 46 wherein said annular disc within said housing is rotatable with said second shaft as said housing is prevented from rotating independently about said second shaft.

* * * * *